US011160153B2

(12) United States Patent
Marinus et al.

(10) Patent No.: US 11,160,153 B2
(45) Date of Patent: Oct. 26, 2021

(54) LIGHTING DEVICE ARRANGED TO BE CONTROLLED VIA A WIRELESS CONTROLLER

(71) Applicant: SIGNIFY HOLDING B.V., Eindhoven (NL)

(72) Inventors: Antonius Adrianus Maria Marinus, Eindhoven (NL); Paul Theodorus Jacobus Boonen, Tegelen (NL); Martinus Wilhelmus Blum, Eindhoven (NL); Andrew Ulrich Rutgers, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/480,524

(22) PCT Filed: Dec. 21, 2017

(86) PCT No.: PCT/EP2017/083974
§ 371 (c)(1),
(2) Date: Jul. 24, 2019

(87) PCT Pub. No.: WO2018/137864
PCT Pub. Date: Aug. 2, 2018

(65) Prior Publication Data

US 2019/0387600 A1 Dec. 19, 2019

(30) Foreign Application Priority Data

Jan. 26, 2017 (EP) ..... 17153347

(51) Int. Cl.
*H05B 47/19* (2020.01)
*H05B 45/30* (2020.01)
(Continued)

(52) U.S. Cl.
CPC ..... *H05B 47/19* (2020.01); *H05B 45/3578* (2020.01); *H05B 47/195* (2020.01)

(58) Field of Classification Search
CPC ..... H05B 45/00; H05B 45/10; H05B 47/10; H05B 47/19; H05B 47/195; H05B 47/175; H05B 45/30; H05B 45/37; H05B 45/3578
See application file for complete search history.

(56) References Cited

U.S. PATENT DOCUMENTS 8,184,674 B2 5/2012 Pope
2011/0012528 A1* 1/2011 Tsui ..... H05B 41/3924 315/291
(Continued)

FOREIGN PATENT DOCUMENTS

CN 202956454 U 5/2013
EP 2306776 B1 4/2011
(Continued)

*Primary Examiner* — Thai Pham
(74) *Attorney, Agent, or Firm* — Daniel J. Piotrowski

(57) ABSTRACT

A lighting device arranged to be controlled via a wireless controller, wherein said lighting device comprises a light emitting load arranged for emitting light, a driver arranged for receiving a supply voltage and for driving said light emitting load based on said received supply voltage, an auxiliary supply arranged for supplying an auxiliary Direct Current, DC, supply voltage, a wireless receiver, connected to and powered by said auxiliary supply, arranged for wirelessly receiving, from said wireless controller, a control signal, and for activating said driver based on said received control signal, wherein said wireless receiver is arranged to operate according to a pulsed listen mode, said pulsed listen mode comprising active phases in which said wireless receiver is able to receive said control signal and non-active phases in which said wireless receiver is not able to receive said control signal.

10 Claims, 4 Drawing Sheets

(51) Int. Cl.
*H05B 45/3578* (2020.01)
*H05B 47/195* (2020.01)

(56) References Cited

U.S. PATENT DOCUMENTS

| | | | | |
|---|---|---|---|---|
| 2012/0063186 | A1* | 3/2012 | Tsui | H05B 39/08 363/126 |
| 2012/0313531 | A1 | 12/2012 | Macleod | |
| 2015/0288293 | A1* | 10/2015 | Siessegger | H05B 45/37 315/246 |
| 2016/0286628 | A1* | 9/2016 | Cho | H05B 47/22 |
| 2019/0191534 | A1* | 6/2019 | De Bruycker | H05B 45/50 |

FOREIGN PATENT DOCUMENTS

| | | | |
|---|---|---|---|
| JP | 2007174096 | A | 7/2007 |
| WO | 2015056161 | A1 | 4/2015 |

* cited by examiner

LIGHTING DEVICE ARRANGED TO BE CONTROLLED VIA A WIRELESS CONTROLLER

CROSS-REFERENCE TO PRIOR APPLICATIONS

This application is the U.S. National Phase application under 35 U.S.C. § 371 of International Application No. PCT/EP2017/083974, filed on Dec. 21, 2017, which claims the benefit of European Patent Application No. 17153347.4, filed on Jan. 26, 2017. These applications are hereby incorporated by reference herein.

FIELD OF THE INVENTION

The present invention generally relates to the field of lighting and, more specifically, to a lighting device arranged to be controlled via a wireless controller. The present invention further relates to a lighting assembly comprising a lighting device and the wireless controller and related to a method of operating a lighting device.

BACKGROUND OF THE INVENTION

It is expected that in future lighting applications the same evolution is to take place as has happened with respect to the television world. That is, a lighting device will be supplied directly from a mains power supply thereby circumventing a wall switch. The wall switch will thus disappear and the lights will be controlled by wireless controllers, i.e. remote controllers. Several techniques can be used for controlling the lighting device such as based on Infrared, Radio Frequency or even ultra-sonic.

Presently, several regulations are introduced, or being introduced, which requires the lighting devices to have limited power consumption in the stand-by mode. That is, whenever the lighting device is not switched on, it should have a power consumption less than a certain threshold. In the conventional situation, i.e. with a wall switch, this requirement would be easily met as the lighting device would not consume power at all. However, in the new situation, the lighting devices should have a receiver that is activated during the stand-by as the receiver should be able to receive control signals from the wireless controller.

The above is especially true for Light Emitting Diode, LED, lamps and LED luminaires that can be wirelessly controlled. These types of lamps often have a plurality of functions such as an acoustic function, air multiplication, air purification, sensors, and camera, which all contribute to the power consumption of the LED lamps. To operate in an effective manner, these functions should be dealt with efficiently.

US 2012/063186 discloses a low current consumption control switch device and method related thereto. The control switch device includes a switch control component, a microprocessor, a wireless signal receiver for receiving control signal and a DC power supply. The DC power supply draws an AC current from the AC power supply to power the wireless signal receiver, the microprocessor and the switch control component. The switch control component has a control input for receiving control instructions to control current supply from the AC power supply. The microprocessor is operatively connected to the switch control component for providing control instructions to alter its switching state. The control signal comprises a preamble and a message portion. The wireless signal receiver is configured to alternate between at least two current consumption modes and to remain in a higher current consumption mode upon detection of the preamble.

Following the above, it is a drawback of known remotely controlled lighting devices that they consume too much power in a standby mode, i.e. a mode in which the lighting devices are not emitting any light, but are able to receive control signals from remote wireless controllers.

SUMMARY OF THE INVENTION

It would be advantageous to achieve a lighting device that has a relatively low power consumption in a so called standby mode, i.e. in a mode in which the lighting device is not emitting light but is receptive for wirelessly receiving control signals. It would also be desirable to achieve a lighting assembly comprising such a lighting device as well as a wireless controller. It would further be desirable to achieve a method of operating a lighting device such that the lighting device has relatively low power consumption in the standby mode.

To better address one or more of these concerns, in a first aspect of the disclosure, a lighting assembly is provided. The lighting assembly comprises a lighting device and a wireless controller for controlling the lighting device, wherein the lighting device comprises:

a light emitting load arranged for emitting light, a driver arranged for receiving a supply voltage and for driving the light emitting load based on the received supply voltage, an auxiliary supply arranged for supplying an auxiliary supply voltage, and a wireless receiver, connected to and powered by the auxiliary supply, arranged for wirelessly receiving, from the wireless controller, a control signal, and arranged for activating the driver based on the received control signal, wherein the wireless receiver is arranged to operate according to a pulsed listen mode, the pulsed listen mode comprising active phases in which the wireless receiver is able to receive the control signal and non-active phases in which the wireless receiver is not able to receive the control signal, wherein the wireless controller is arranged for receiving the supply voltage, and wherein the wireless receiver and the wireless controller are arranged to have a synchronized communication with each other by using a zero crossing of the supply voltage as a synchronization reference.

It was the insight of the inventors that the power consumed by the lighting device, in situations wherein the lighting device is not emitting light, is decreased in case the wireless receiver is arranged to operate according to the pulsed listen mode.

The wireless receiver consumes power whenever it is listening. That is, whenever it is in a receiving mode in which it is capable to receive control signals. As such, the inventors have found that it is not necessary that the wireless receiver is active all the time as this is not beneficial for the power consumption process. The total power consumed by the receiver is thus decreased by activating the wireless receiver during short periods of time, and by deactivating the wireless receiver during the remainder of the time.

In accordance with the present disclosure, a pulsed listen mode means that the receiver is alternatingly activated and deactivated. The wireless receiver is able to receive control signals whenever it is activated and the wireless receiver is not able to receive control signals whenever it is deactivated.

The inventors have found that the wireless receiver is to be powered by the auxiliary supply to further decrease the power consumption of the lighting device in situations wherein the lighting device is not emitting light. This enables the lighting device to switch off the AC supply voltage. As such, there is no loss in efficiency and/or power in the driver that is arranged to receive the AC supply voltage and provide power to the light emitting load. The wireless receiver is then arranged to activate the driver whenever a control signal has been received. This will make sure that the AC supply voltage is provided to the driver, and that the driver converts the AC supply voltage to the DC supply voltage which is provided to the light emitting load.

Synchronizing the communication of the wireless receiver and the wireless controller with each other by using a zero crossing of the supply voltage as a synchronization reference reduces the chance that the wireless receiver misses the information sent by the wireless controller.

In another example, a lighting device is provided. The lighting device comprises:

a light emitting load arranged for emitting light, a driver arranged for receiving a supply voltage and for driving the light emitting load based on the received supply voltage, an auxiliary supply arranged for supplying an auxiliary supply voltage, and a wireless receiver, connected to and powered by the auxiliary supply, arranged for wirelessly receiving, from the wireless controller, a control signal, and arranged for activating the driver based on the received control signal, wherein the wireless receiver is arranged to operate according to a pulsed listen mode, the pulsed listen mode comprising active phases in which the wireless receiver is able to receive the control signal and non-active phases in which the wireless receiver is not able to receive the control signal, wherein the wireless receiver and the wireless controller are arranged to have a synchronized communication with each other by using a zero crossing of the supply voltage as a synchronization reference.

In another example a wireless controller is provided. The wireless controller is arranged for receiving the supply voltage, wherein the wireless receiver and the wireless controller are arranged to have a synchronized communication with each other by using a zero crossing of the supply voltage as a synchronization reference.

In another aspect, a lighting device arranged to be controlled via a wireless controller is provided. The lighting device comprises:

a light emitting load arranged for emitting light;

a driver arranged for receiving a supply voltage and for driving said light emitting load based on said received supply voltage, for example an Alternating Current, AC, supply voltage;

an auxiliary supply arranged for supplying an auxiliary Direct Current, DC, supply voltage;

a wireless receiver, connected to and powered by said auxiliary supply, arranged for wirelessly receiving, from said wireless controller, a control signal, and for activating said driver based on said received control signal, wherein said wireless receiver is arranged to operate according to a pulsed listen mode, said pulse listen mode comprising active phases in which said wireless receiver is able to receive said control signal and non-active phases in which said wireless receiver is not able to receive said control signal.

It was the insight of the inventors that the power consumed by the lighting device, in situations wherein the lighting device is not emitting light, is decreased in case the wireless receiver is arranged to operate according to the pulsed listen mode.

The wireless receiver consumes power whenever it is listening. That is, whenever it is in a receiving mode in which it is capable to receive control signals. As such, the inventors have found that it is not necessary that the wireless receiver is active all the time as this is not beneficial for the power consumption process. The total power consumed by the receiver is thus decreased by activating the wireless receiver during short periods of time, and by deactivating the wireless receiver during the remainder of the time.

In accordance with the present disclosure, a pulsed listen mode means that the receiver is alternatingly activated and deactivated. The wireless receiver is able to receive control signals whenever it is activated and the wireless receiver is not able to receive control signals whenever it is deactivated.

The inventors have found that the wireless receiver is to be powered by the auxiliary supply to further decrease the power consumption of the lighting device in situations wherein the lighting device is not emitting light. This enables the lighting device to switch off the AC supply voltage. As such, there is no loss in efficiency and/or power in the driver that is arranged to receive the AC supply voltage and provide power to the light emitting load. The wireless receiver is then arranged to activate the driver whenever a control signal has been received. This will make sure that the AC supply voltage is provided to the driver, and that the driver converts the AC supply voltage to the DC supply voltage which is provided to the light emitting load.

Preferably, the wireless receiver is comprised in a micro controller. The micro controller may comprise further functionality like a transmitter, brightness settings, color settings and even the driver itself. It is further advantageous that the micro controller is powered by the auxiliary supply, in situations wherein the lighting device does not emit light, in such a way that only the wireless receiving function is active. During the situation that the lighting device does not emit light, there is no need for the micro controller to have the remaining functions up and running. At least the functionality for receiving the control signal and for activating the driver should be available, and should thus be powered by the auxiliary supply.

In an example of the present disclosure, the lighting device is a Light Emitting Diode, LED, lighting device. The LED lighting device may be a retrofit LED tube. A retrofit LED tube is designed for replacing traditional fluorescent lamps, i.e. for retrofit applications. For such an application, a retrofit LED tube is typically adapted to fit into the socket of the respective lamp fixture to be retrofitted. Moreover, since the maintenance of a lamp is typically conducted by a user, the retrofit LED tube should ideally be readily operational with any type of suitable fixture without the need for re-wiring the fixture.

The light emitting load may thus comprise an array of LEDs. The LEDs may comprise white LEDs, colored LEDs, high power LEDs, or anything alike. Further, the LEDs may be cascaded in a plurality of branches, wherein each branch is driven separately by the driver.

In accordance with the present disclosure, the lighting device is arranged to be controlled via a wireless controller, for example a remote control unit. The remote control unit is, for example, powered by one or more batteries. Typically, the remote control unit is a hand-held device suitable to be operated by a single user.

It is further noted that the auxiliary supply may be recharged again during situations in which the lighting device is emitting light. That is, the driver is driving the light emitting load and, at the same time, the AC supply voltage is converted to a DC voltage suitable to recharge the auxiliary supply. This would make sure that sufficient energy is stored, in the auxiliary supply, for empowering the wireless receiver during situations in which the lighting device does not emit light. The same driver may be used for recharging the auxiliary supply as is used for driving the light emitting load.

Synchronization of the communication between the wireless controller and the wireless receiver may be synchronized with the zero crossings of the supply voltage or number of mains cycles away, like 50 Hz or 25 Hz. This improves the chance for the receiver in pulsed listening mode to receive a message from the controller.

In accordance with the present invention, the control signal may be based on any of a radio or radio-frequency, RF, signal or an infra-red, IR, signal, for example, operated in accordance with a standardized or proprietary signaling protocol. In practice, wireless radio transmission technologies available for use with the invention are, inter alia, ZigBee™, Bluetooth™, WiFi based protocols, or any mesh type of wireless network.

Further, the wireless controller may wireless send the control signal using an application "app". The wireless controller is then a mobile device, such as a mobile phone or a tablet.

In an embodiment, the pulsed listen mode comprises a repetitive pattern of subsequent pulses, wherein said pulse listen mode is in an active phase during a pulse and in a non-active phase between subsequent pulses.

More specifically, the pulsed listen mode may comprise a duty cycle between 5%-15%, and wherein a duration of a pulse is between 30 ms-100 ms.

The inventors have found that control signals can be received correctly even with such a low duty cycle. Typically, the information contained in the control signal is very limited and the control signal, i.e. the control message itself, is thus of limited length. Basically, the control signal needs to convey information that the lighting device is to be activated, i.e. turned on. As such, a very small window, i.e. pulse duration, is sufficient for receiving such a message correctly.

Using such a low duty cycle has the advantage that the total power consumption of the wireless receiver is also decreased significantly. This because the wireless receiver is only consuming significant power during the duration of a pulse. In the remainder of the time, i.e. between subsequent pulses, the wireless receiver is not active and thus not actively consuming a significant amount of power.

In a further embodiment, the lighting device further comprises a wireless transmitter arranged for wirelessly transmitting an acknowledgement message to said wireless controller upon correct receipt of said control signal.

The inventors have found that, in order to make the lighting device more robust, it is likely that the wireless controller will send the same control signal a plurality of times. This would increase the likelihood that the control signal is received correctly. It is advantageous in case the wireless transmitter transmits an acknowledgement message to the wireless controller upon correct receipt of the control signal in order to circumvent the situation that the wireless controller is sending the same control signal over and over again. The wireless controller may stop transmitting the same control signal over and over again once the acknowledgement message has been received by the wireless controller as this is an indication that the lighting device has correctly received the control signal.

In an embodiment, said driver is further arranged to convert said AC supply voltage to an DC voltage, and for providing said DC voltage to said wireless receiver for additionally empowering said wireless receiver.

As mentioned above, the functionality of the wireless receiver may be implemented in a micro controller, wherein the microcontroller also possesses other functionality that can be executed. However, during the deactivated phase, it is not required that all other functionality is also up and running. As such, the inventors have found that the auxiliary supply may only supply the wireless receiving functionality of the micro controller as well as the functionality for enabling the driver but does not empower the micro controller for the remainder of the functionalities.

It is noted that the wireless receiver, as well as the driver, may be implemented in any type of hardware such as a microprocessor, a micro controller, a Field Programmable Gate Array, FPGA, or anything alike.

In a further embodiment, said auxiliary supply is a capacitive supply. The capacitive supply is for example implemented as a capacitor. Alternatively, or in addition thereto, the auxiliary supply may comprise a battery for empowering the wireless receiver.

In yet another embodiment, the lighting device is powered by a mains power supply, and wherein said wireless receiver is arranged to operate according to a pulsed listen mode such that said active phases of said pulsed listen mode are synchronized with said mains power supply, for example based on any of a phase of said mains power supply and a cycle of said mains power supply.

The inventors have recognized the challenge that many transmitters need to retransmit frequently in the expectation of hitting an active phases of the wireless receiver. However, it was recognized that the transmitter and the wireless receiver may also be synchronized to a common time base. This may require additional clock components, but could be helpful for the efficiency aspects. In order to do so, the inventors have found that in many situations, the mains power supply is available to the lighting device as well as to the transmitter. It is therefore an insight of the inventors to synchronize the active phases of the wireless receiver with the mains power supply to further increase the probability that transmissions are received.

It is noted that both the mains phase, e.g. a couple of milliseconds after a zero crossing, and number of cycles, e.g. every $9^{th}$ mains cycle, or a combination thereof could be used to synchronize matters.

According to the present disclosure, the light emitting load, the driver, the auxiliary supply and the wireless receiver may be integrally accommodated in a single housing, such as a light transmissive housing or a partly light transmissive housing, configured as a retrofit tube type, for example.

In a second aspect, the inventions provides for a lighting assembly, comprising:

a lighting device according to any of the previous claims, and a wireless controller arranged for wirelessly transmitting a control signal to said lighting device.

It is noted that the advantages and definitions as disclosed with respect to the embodiments of the first aspect of the invention, being the lighting device, also correspond to the embodiments of the second aspect of the invention, being the lighting assembly, respectively.

The wireless controller may be implemented as a wireless remote control suitable to be held by a person. Alternatively, the wireless controller may be implemented as a mobile user device such as a tablet or a smart phone. Here, the mobile user device may comprise an "app" for transmitting the wireless control signal towards the lighting device. Even further, the wireless controller may be implemented as a battery powered switch which can be mounted on a wall or the like. Typically, the control signal only needs to indicate that the lighting device should return to an active state, i.e. a light emitting state, such that a digital switch should be sufficient for this purpose. The wall mounted switch may be mounted using screws or adhesive tape of the like.

In an embodiment, the wireless controller is arranged to repeatedly transmit the same control signal to said lighting device thereby ensuring that said wireless receiver has received said control signal.

The advantage of this embodiment is that the probability that the control signal is correctly received by the lighting device is increased. It may occur that one or more control signals transmitted by the wireless controller are not correctly received by the lighting device as the wireless receiver was not active during those moments. However, by repeatedly transmitting the same control signal, the probability that at least one of those control signals is correctly received by the wireless receiver is increased.

In a further embodiment, the wireless controller is further arranged to receive an acknowledgement message, from said lighting device, thereby indicating that said transmitted control signal is correctly received by said wireless controller of said lighting device.

In a third aspect, the invention provides in a method of operating a lighting device according to any of the embodiments as described above, wherein said method comprises the steps of:

activating said wireless receiver during active phases of said pulse listen mode such that said wireless receiver is able to receive said control signal, and deactivating said wireless receiver during non-active phases of said pulse listen mode such that said wireless receiver is not able to receive said control signal, receiving, by an activated wireless receiver, said wireless control signal from said wireless controller, and activating, by said wireless receiver, said driver based on said received control signal such that said light emitting load of said lighting device starts emitting light.

It is noted that the advantages and definitions as disclosed with respect to the embodiments of the first and second aspect of the invention, being the lighting device and the lighting assembly, respectively, also correspond to the embodiments of the third aspect of the invention, being the method of operating the lighting device, accordingly.

In an embodiment, the pulsed listen mode comprises a repetitive pattern of subsequent pulses, wherein said pulse listen mode is in an active phase during a pulse and in a non-active phase between subsequent pulses.

In a further embodiment, the pulsed listen mode comprises a duty cycle between 5%-15%, and wherein a duration of a pulse is between 30 ms-100 ms.

In yet another embodiment, the method further comprises the step of:

wirelessly transmitting, by said wireless transmitter, said acknowledgement message to said wireless controller upon correct receipt of said control signal.

In an embodiment, the method further comprises the step of:

transmitting said control signal, by said wireless controller, to said lighting device.

In another embodiment, the method further comprises the step of:

repeatedly transmitting a same control signal to said lighting device until said wireless controller has received an acknowledgement message from said lighting device thereby ensuring that said wireless receiver has received said control signal.

The method may be effectively performed by a suitable programmed processor or programmable controller, such as a microprocessor or micro controller provided with the lighting device.

As such, the present disclosure is also directed to a computer program product, comprising a readable storage medium, comprising instructions which, when executed on at least one processor, cause the at least one processor to carry out the method according to any of the embodiments as disclosed above.

These and other aspects of the inventions will be apparent from and elucidated with reference to the embodiment(s) described hereinafter.

DETAILED DESCRIPTION

Figure 1:
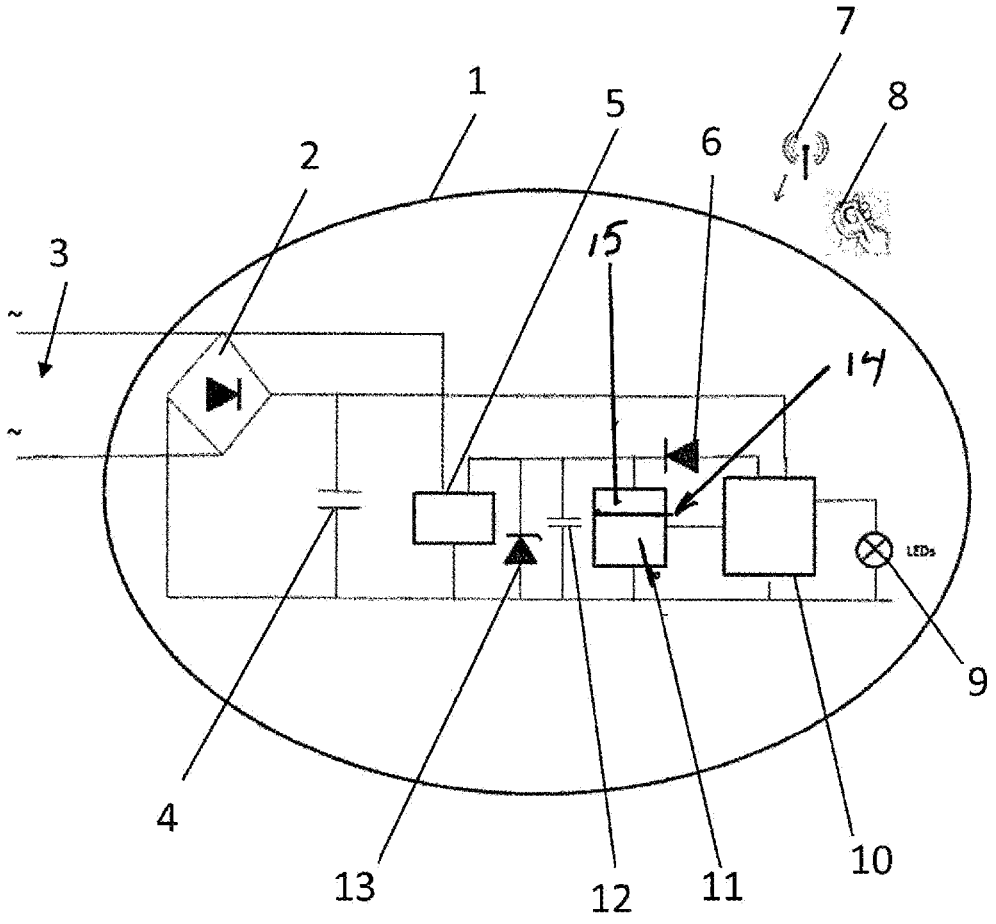
FIG. 1 shows a lighting device according to an embodiment of the present disclosure.

Reference numeral 1 in FIG. 1 designates a lighting device arranged to be controlled via a wireless controller. More specifically, in the present example, the lighting device is a retrofit Light Emitting Diode, LED, lamp. A LED lamp is retrofitted in case it fits in conventional armatures for conventional incandescent or halogen lamps. In order to fit in these conventional armatures, the retrofit LED lamp 1 comprises conducting pens for connecting, and supporting, the retrofit LED lamp 1 in the conventional armatures.

The retrofit LED lamp 1 comprises a light emitting load 9, more specifically an LED array 9, for emitting light. The LED array 9 may comprise a plurality of series and parallel connected LED's. Those skilled in the art will appreciate that in practical embodiments the LEDs are evenly distributed and spaced apart across the length of the lamp 1, to provide for an evenly as possible lighting by the LED lamp 1 over its entire length. The present disclosure is not limited to any specific type of LED, nor to any color LEDs. Typically, white colored LEDs are used.

The retrofit LED lamp 1 comprises a driver 10 arranged for receiving a supply voltage and for driving the light emitting load 9 based on the received supply voltage. It is noted that the driver may directly receive an Alternating Current, AC, supply voltage, but may also receive a Direct Current, DC, supply voltage. In the present example, a rectifier 2 is provided in the retrofit LED lamp 1.

The rectifier 2 has an input and an output, wherein the rectifier 2 is arranged to receive an AC mains supply voltage at its input, to convert the AC supply voltage to a DC voltage, and to provide the DC voltage to the driver 10. The rectifier 2 comprises for example four diodes for rectifying the AC voltage to a DC voltage.

The mains AC supply voltage is indicated with reference numeral 3. The AC supply voltage 3 is provided to the retrofit LED lamp 1 via a socket. Such a socket is, for example, a traditional socket which is also used for connecting fluorescent tubes.

The retrofit LED lamp 1 may further comprise a capacitor 4 for further rectifying the DC voltage which is outputted by the rectifier 2. The capacitor 4 may thus function as some sort of buffer to make sure that the DC voltage does not fluctuate too much.

Further, an auxiliary supply 5 is provided which is arranged for supplying an auxiliary Direct Current, DC, supply voltage. The auxiliary supply 5 is shown as a block diagram. Typically, a capacitor is provided in the block diagram, which capacitor acts as a storage unit for providing the DC supply voltage. Further, logics may be provided to make sure that the auxiliary supply is recharged whenever the retrofit LED lamp 1 is turned on, and that the auxiliary supply is not recharged whenever the retrofit LED lamp 1 is turned off.

A Zener diode 13 may be provided at the output of the auxiliary supply 5 to make sure that the DC supply voltage provided by the auxiliary supply 5 is more or less a steady voltage. Further, a capacitor 12 may be provided to further stabilize the DC supply voltage.

The retrofit LED lamp 1 further comprises a wireless receiver 11, connected to and powered by the auxiliary supply 5, which wireless receiver 11 is arranged for wirelessly receiving, from the wireless controller, a control signal, and for activating the driver 10 based on the received control signal.

The wireless receiver 11 depicted in FIG. 1 is shown as a block diagram. It is noted that, typically, the wireless receiver is a wireless receiving function embodied in a micro controller or a microprocessor. The wireless receiving function may alternatively be embodied in a Field Programmable Gate Array, FPGA.

One of the aspects of the present disclosure is that the wireless receiver 11 is operating according to a pulsed listen mode, wherein the pulsed listen mode comprises active phases in which the wireless receiver 11 is able to receive the control signal and non-active phases in which the wireless receiver 11 is not able to receive the control signal.

Following the above, it is noted that the wireless receiver 11 is deactivated during the non-active phases such that the wireless receiver 11 consumes less power compared to the situations in which the wireless receiver 11 is activated, i.e. during the active phases.

As such, at least in situations in which the retrofit LED lamp 1 is not emitting light, the total power consumption of the retrofit LED lamp 1 is reduced. It is further noted that the remaining functionality of the retrofit LED lamp 1, like the driver, other functionality comprised in the same micro controller may be shut off. This further reduces the power consumption of the retrofit LED lamp 1.

In accordance with the present disclosure, a pulsed listen mode means that the wireless receiver is alternately in a listening mode, i.e. in a mode in which it is receptive for control signals, and in a silent mode, i.e. in a mode in which it is not receptive for control signals. During the silent mode, the wireless receiver 11 consumes less power compared to the same wireless receiver 11 in the listening mode.

The inventors have found that the wireless receiver 11 does not need to be active all the time to make sure that the control signal is sent. Typically, the wireless receiver needs to have a duty cycle of about 5%-15%, and a pulse duration of about 30 ms-100 ms, to make sure that there is a high probability that any control signal that is transmitted is also correctly received.

The retrofit LED lamp 1 further comprises a diode 6 which is used to recharge the auxiliary supply 5 in situations in which the driver is active, i.e. in which the light emitting load 9 is actually emitting light. The output of the driver 10 is then fed back to the auxiliary supply 5 via the diode 6.

FIG. 1 further shows a wireless controller 8 in the form of a remote controller 8 and a wireless access point 7 which is used for communication between the retrofit LED lamp 1 and the remote controller 8.

The remote controller 8 may send the control signal repeatedly to make sure that the retrofit LED lamp 1 will correctly receive the transmitted control signal. This is especially true for the present disclosure as the wireless receiver 11 of the retrofit LED lamp 1 is operating according to the pulsed listen mode. That is, the wireless receiver 11 is not able to receive any transmitted signal in between the pulses of the pulsed listen mode, i.e. in situations in which the wireless receiver 11 is deactivated.

As further depicted in FIG. 1, it is noted that the micro controller 14 which embeds the receiving function of the wireless receiver H as explained above, may further embed a wireless transmitter 15. The wireless transmitter is used for transmitting an acknowledgement message back to the wireless controller for indicating, to the wireless controller, that the control signal is correctly received. Based upon receipt of the acknowledgement message, by the wireless controller, the wireless controller may cease in repeatedly transmitting the control signal.

It is noted that, in accordance with the present disclosure, a housing may be provided for housing the retrofit LED lamp 1. The housing is schematically indicated with the circle which encloses each of the components shown in FIG. 1. The housing may be a light transmissive housing or a partly transmissive housing, configured as a retrofit tube type, for example.

Figure 2:
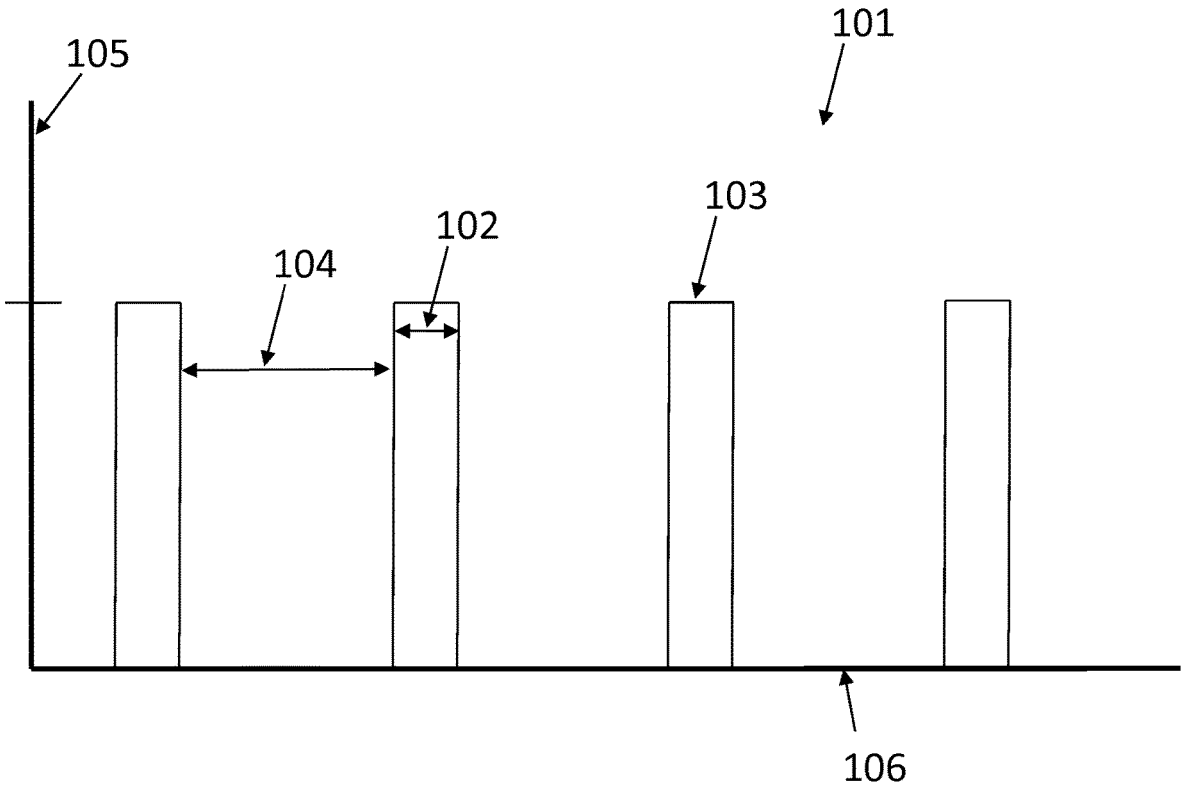
FIG. 2 shows a simplified diagram illustrating an example of a pulsed listen mode as defined in the present disclosure.

FIG. 2 shows a simplified diagram 101 illustrating an example of a pulsed listen mode as defined in the present disclosure.

Here, the vertical axis indicates whether the receiver, i.e. the receiving function, is activated or whether the receiver is deactivated. In case the pulse is high, the receiver is activated; in case the pulse is low, the receiver is deactivated.

In the present example, four pulses are shown wherein one pulse is referenced to with reference numeral 103. The pulse has a pulse width as indicated with reference numeral 102 and has a certain dead time which is indicated with reference numeral 104. It is noted that during the dead time, i.e. the non-active phase, the receiver is not active. This means that the receiver is not able to receive any control signals during this time. The effect hereof is that the receiver is hardly consuming any power such that the total amount of power is reduced significantly.

The pulse width 102 is, preferably, about 30 ms-100 ms. The inventors have found that such a pulse width 102 is more than sufficient to receive a control signal. The receiver should be able to receive the control signal with that amount of time. This should be doable as the control signal is typically a very light weighted message. It is noted that the message, in an embodiment, only has to convey an activation signal such that the message does not have to be lengthy.

The horizontal axis 106 is directed to the time. As such, here, four pulses are received within the time windows displayed. The pulses are, in this particular example, spaced apart evenly. It is however also conceivable that the pulses are not spaced apart evenly, but, for example, randomly or anything alike. Preferably the length of a pulse is tuned to the length of the message of the control signal. This ensures that the power consumed by the receiver is reduced even further.

It is noted that the width of the pulses shown in FIG. 2 are also equal. It is however also conceivable that the width of the pulses is not the same for each pulse. For example, it may be decided to amend the width of the pulses randomly between two values. This could further improve the robustness of the system.

Figure 3:
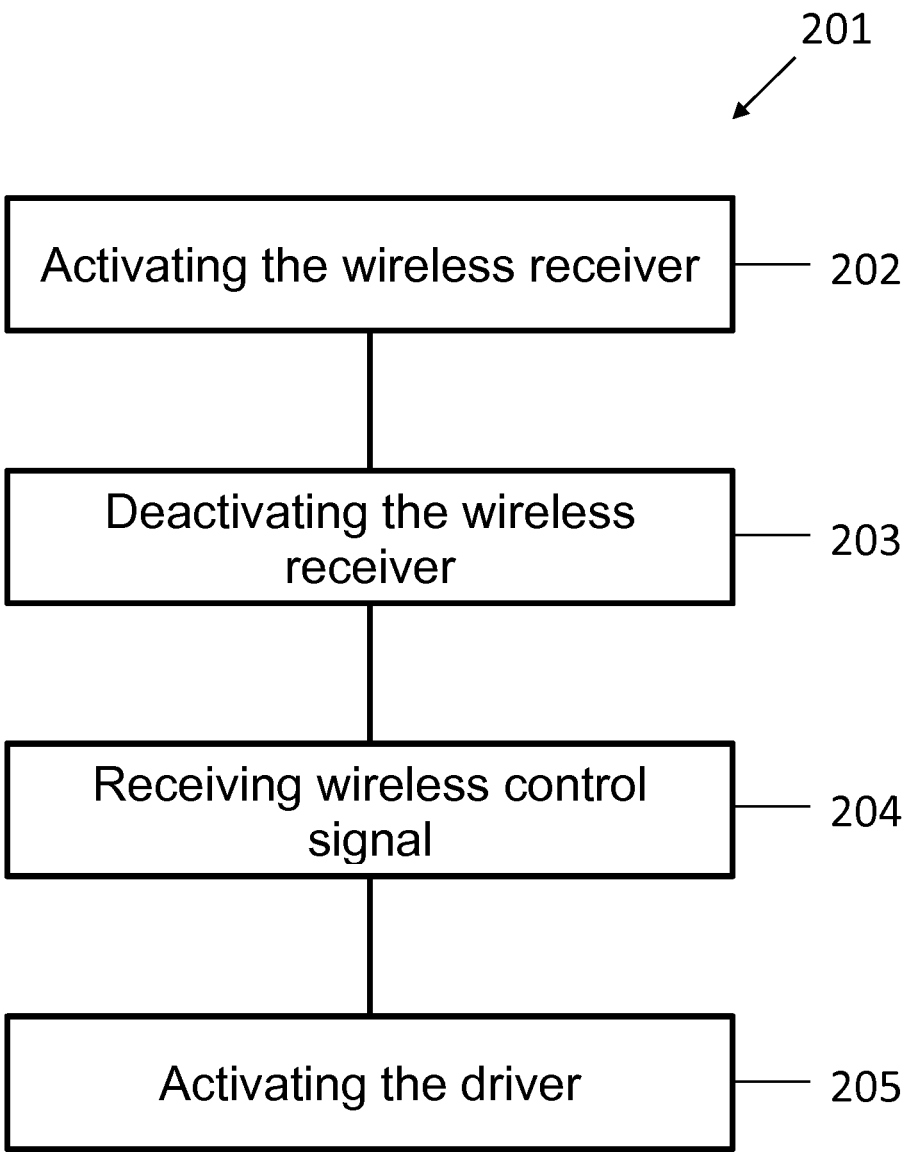
FIG. 3 shows a simplified slow chart diagram illustrating an example of the steps performed in accordance with an embodiment of the present disclosure.

FIG. 3 shows a simplified flow chart diagram 201 illustrating an example of the steps performed in accordance with an embodiment of the present disclosure.

A method of operating a lighting device according to any of the examples as provided above.

The method comprises the steps of:

activating 202 said wireless receiver during active phases of said pulse listen mode such that said wireless receiver is able to receive said control signal, and deactivating 203 said wireless receiver during non-active phases of said pulse listen mode such that said wireless receiver is not able to receive said control signal, receiving 204, by an activated wireless receiver, said wireless control signal from said wireless controller, and activating 205, by said wireless receiver, said driver based on said received control signal such that said light emitting load of said lighting device starts emitting light.

Following the above, the method starts with alternatingly activating and deactivating the receiver according to the pulsed listen mode that is set. An activated receiver is able to receive messages; a deactivated receiver is not able to receive any messages.

At a certain point in time, the wireless receiver will receive a wireless control signal from the wireless controller. It is noted that the receipt of such a message can only occur in situations wherein the wireless receiver is activated, i.e. it is an activated wireless receiver.

Once the control signal has been received, the wireless receiver may activate the driver such that the lighting device starts to emit light. The driver will then enable the mains supply voltage, such that the energy is not drawn from the auxiliary supply but from the mains supply voltage. Further, the driver may be arranged to convert the received mains supply voltage to a DC voltage which is suitable to recharge the auxiliary supply.

It is noted that, in accordance with the present invention, the wireless receiver is powered by the auxiliary supply in situations wherein the lighting device does not emit light. Such a condition may, however, occur for a particularly long time such that there could be a risk that the auxiliary supply runs out of energy.

To combat such a risk, the wireless receiver may be equipped with a safety mechanism. The safety mechanism may initiate in case the voltage provided by the auxiliary supply falls below a predetermined supply voltage. In such situations, the wireless receiver may enable the driver for recharging the auxiliary supply only. As such, the driver does not drive the light emitting load but it only provides a DC output voltage for recharging the auxiliary supply. Alternatively, the wireless receiver may enable another rectifier for recharging the auxiliary supply.

Figure 4:
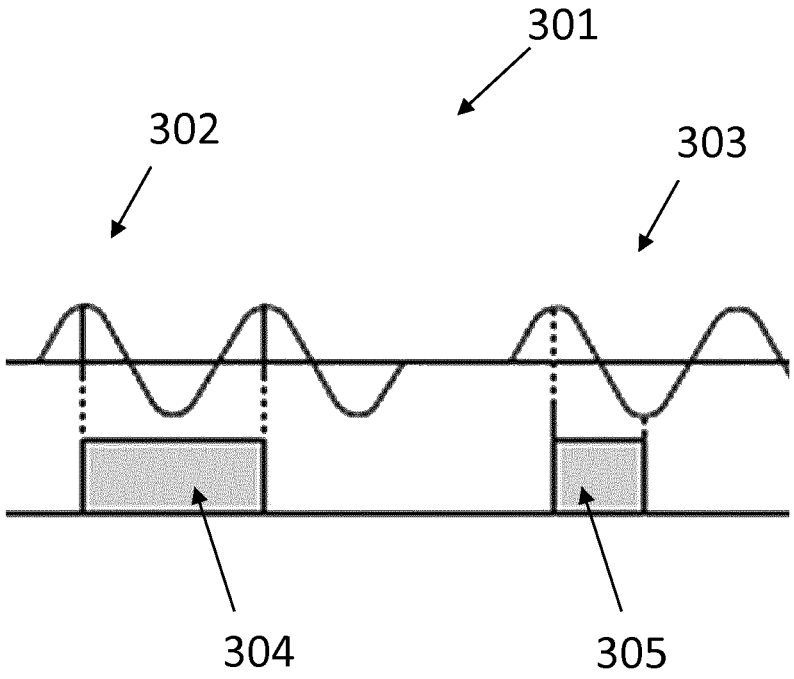
FIG. 4 shows a simplified flow chart diagram illustrating an example of a synchronization scheme for the wireless receiver and the mains power supply.

FIG. 4 shows a simplified flow chart diagram 301 illustrating an example of a synchronization scheme for the wireless receiver and the mains power supply.

Here, two synchronization principles are shown. On the left, as indicated with reference numeral 302, a mains power supply voltage is shown. For example, an Alternating Current, AC, voltage of 230 Vac or anything alike. On the right, as indicated with reference numeral 303, a similar mains power supply voltage is shown. On the left 302, an active phase of the wireless receiver is indicated with reference numeral 304. In this particular case, the active phase 304 is active during a full cycle of the mains power supply. The wireless receiver is then deactivated for, for example, a couple of cycles of the mains power supply. In this particular situation, the start moment of the active phase corresponds to the highest voltage of the AC power supply. Such a construction can be construed using an operational amplifier.

On the right, i.e. as indicated with reference numeral 303, another synchronization scheme is shown. Here, the active phase 305 of the wireless receiver is active for about half of the total period of the cycle of the mains power supply. The active phase may then be repeated for the next cycle having the same, or another, trigger point.

It is noted that in the above described examples, the starting point, i.e. the trigger moment, of the active phase of the wireless receiver equals the top voltage of the AC power supply. It is noted that, in other situations, a zero crossing aspect or reference may be used as a trigger moment for synchronization.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A lighting device comprising:

a light emitting load arranged for emitting light, a driver arranged for receiving an AC supply voltage and for driving the light emitting load based on the received supply voltage, an auxiliary supply arranged for supplying an auxiliary supply voltage, and a wireless receiver implemented in a microcontroller, connected to and powered by the auxiliary supply, wherein the wireless receiver is arranged for wirelessly receiving a control signal from a wireless controller, and arranged for activating the driver based on the received control signal, a wireless transmitter embedded in the microcontroller and arranged for wirelessly transmitting an acknowledgement message to said wireless controller upon correct receipt of said control signal, and wherein the wireless receiver is arranged to operate according to a pulsed listen mode, the pulsed listen mode comprising active phases in which the wireless receiver is able to receive the control signal and non-active phases in which the wireless receiver is not able to receive any communication from the wireless controller, and wherein commencement of the active phases are determined based upon an identifiable reference point of the AC supply voltage waveform.

2. The lighting device according to claim 1, wherein said pulsed listen mode comprises a repetitive pattern of subsequent pulses, wherein said pulse listen mode is in an active phase during a pulse and in a non-active phase between subsequent pulses.

3. The lighting device according to claim 2, wherein said pulsed listen mode comprises a duty cycle between 5%-15%, and wherein a duration of a pulse is between 30 ms 100 ms.

4. The lighting device according to claim 1, wherein said driver is further arranged to convert said AC supply voltage to an DC voltage, and for providing said DC voltage to said wireless receiver for additionally empowering said wireless receiver.

5. The lighting device according to claim 1, wherein said auxiliary supply is a capacitive supply.

6. The lighting device according to claim 1, wherein said identifiable reference point is based on at least one of:

a phase of said mains power supply;

a cycle of said mains power supply.

7. A lighting assembly, comprising:

a lighting device according to claim 1, and a wireless controller arranged for wirelessly transmitting a control signal to said lighting device, wherein said wireless controller is arranged to repeatedly transmit the same control signal to said lighting device thereby ensuring that said wireless receiver has received said control signal.

8. A method of operating a lighting device, the lighting device having an AC supply voltage for providing power via a driver to a light emitting load, a wireless receiver implemented in a microcontroller and arranged for wirelessly receiving a control message from a wireless controller, and a wireless transmitter implemented in a microcontroller and arranged for wirelessly transmitting an acknowledgement message to said wireless controller; wherein said method comprises the steps of:

activating said wireless receiver during active phases of said pulse listen mode such that said wireless receiver is able to receive said control signal, wherein commencement of the active phases are determined based upon an identifiable reference point of the AC supply voltage waveform, and deactivating said wireless receiver during non-active phases of said pulse listen mode such that said wireless receiver is not able to receive any communication from the wireless controller, receiving, by an activated wireless receiver, said wireless control signal from said wireless controller, transmitting an acknowledgement message to said wireless controller, and activating, by said wireless receiver, said driver based on said received control signal such that said light emitting load of said lighting device starts emitting light.

9. The method according to claim 8, wherein said pulsed listen mode comprises a repetitive pattern of subsequent pulses, wherein said pulse listen mode is in an active phase during a pulse and in a non-active phase between subsequent pulses.

10. The method according to claim 9, wherein said pulsed listen mode comprises a duty cycle between 5%-15%, and wherein a duration of a pulse is between 30 ms 100 ms.

* * * * *